United States Patent [19]

Essen

[11] Patent Number: 4,655,373

[45] **Date of Patent: * Apr. 7, 1987**

[54] WATER PITCHER

[75] Inventor: R. Eric Essen, St. Louis, Mo.

[73] Assignee: Gateway Plastics, Inc., St. Louis, Mo.

[ * ] Notice: The portion of the term of this patent subsequent to Jan. 8, 2002 has been disclaimed.

[21] Appl. No.: 629,989

[22] Filed: Jul. 11, 1984

Related U.S. Application Data

[63] Continuation-in-part of Ser. No. 319,110, Nov. 9, 1981, Pat. No. 4,492,323.

[51] Int. Cl.[4] ..... A47G 19/14

[52] U.S. Cl. ..... 222/465.1; 220/339

[58] Field of Search ..... 222/465 R, 556, 469–473, 222/543, 565, 480, 566, 567; 220/339, 337

[56] References Cited

U.S. PATENT DOCUMENTS

| | | | |
|---|---|---|---|
| D. 200,018 | 1/1965 | Brocken | D58/17 |
| 2,312,380 | 3/1943 | Bernhardt | 222/472 |
| 2,950,847 | 8/1960 | Tupper | 222/465 R |
| 3,180,540 | 4/1965 | Tupper | 222/545 |
| 3,409,188 | 11/1968 | Wright | 222/480 |
| 3,476,297 | 11/1969 | Swett et al. | 222/480 |
| 3,841,528 | 10/1974 | Eisenberg | 222/143 |
| 3,861,565 | 1/1975 | Rickmeier, Jr. | 222/470 |
| 4,059,201 | 11/1977 | Foster | 220/258 |
| 4,492,323 | 1/1985 | Essen | 222/556 |

*Primary Examiner*—H. Grant Skaggs
*Assistant Examiner*—Kenneth Noland
*Attorney, Agent, or Firm*—Rogers, Howell, Moore & Haferkamp

[57] ABSTRACT

A pitcher for pouring water or other liquids having a container portion. A lid is hinged at the top of the container portion allowing pivoting of the lid between an open position for access to the interior of the container and a closed position for covering same. A spout is located at the hinge, and preferably a handle is located at the side of the pitcher opposite the spout and hinge, whereby the contents are poured, and the lid opens, in a direction away from the handle. In one embodiment the entire container portion and handle are integral. In other embodiments the container portion comprises a ring portion and a disposable cup portion, the lid being hinged to the ring portion and the handle being located at the side of the ring opposite the spout and hinge. There also may be included a flap at the spout opening which is mounted for swinging movement between a closed position with the pitcher upright, and an open position with the pitcher tilted for pouring.

25 Claims, 21 Drawing Figures

FIG. 1.
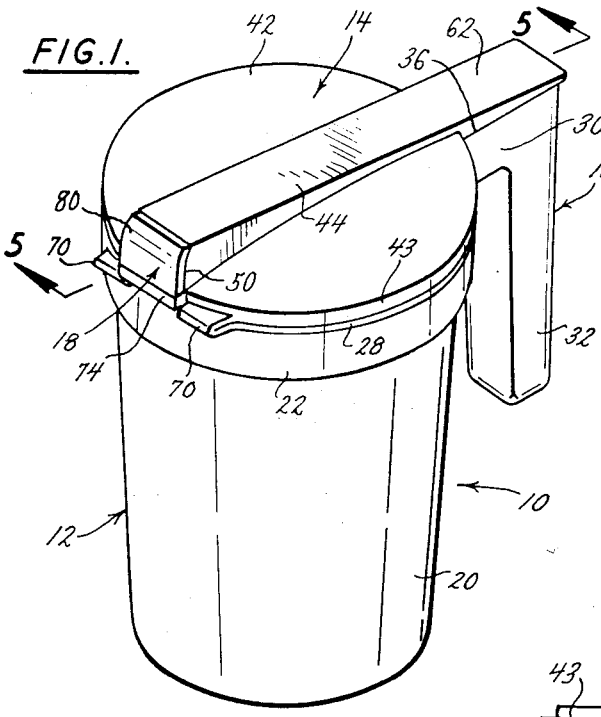
FIG. 10.
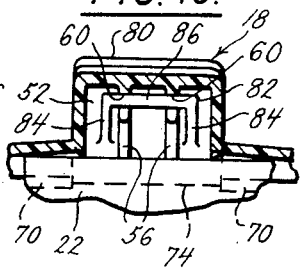
FIG. 9.
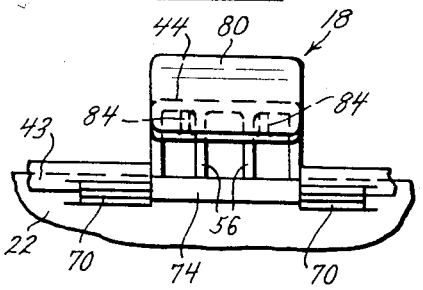
FIG. 2.
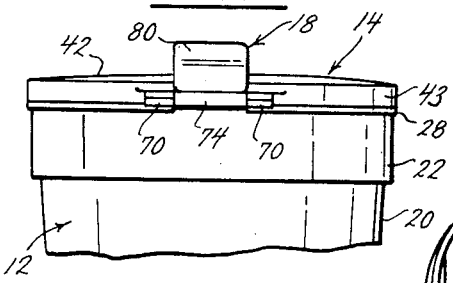
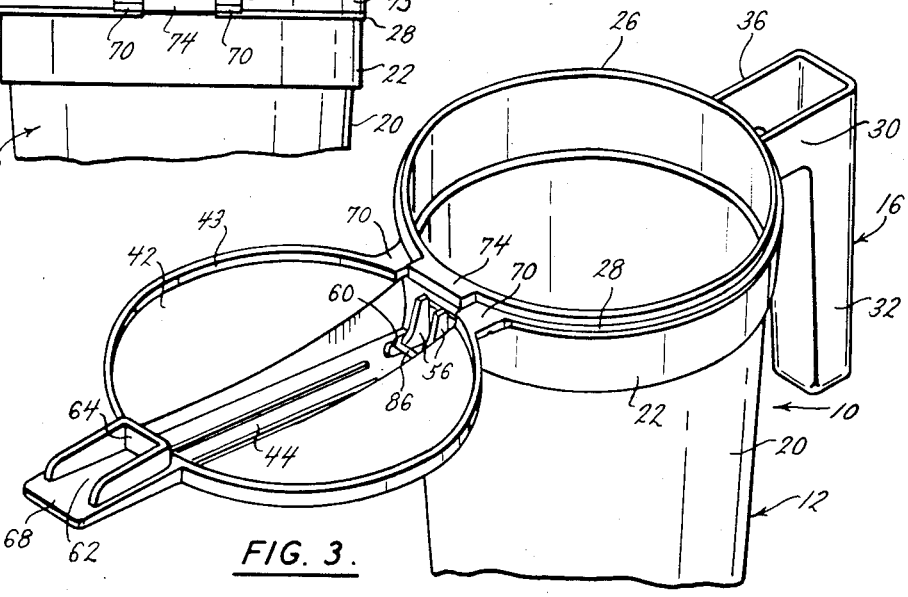
FIG. 3.

FIG. 11.
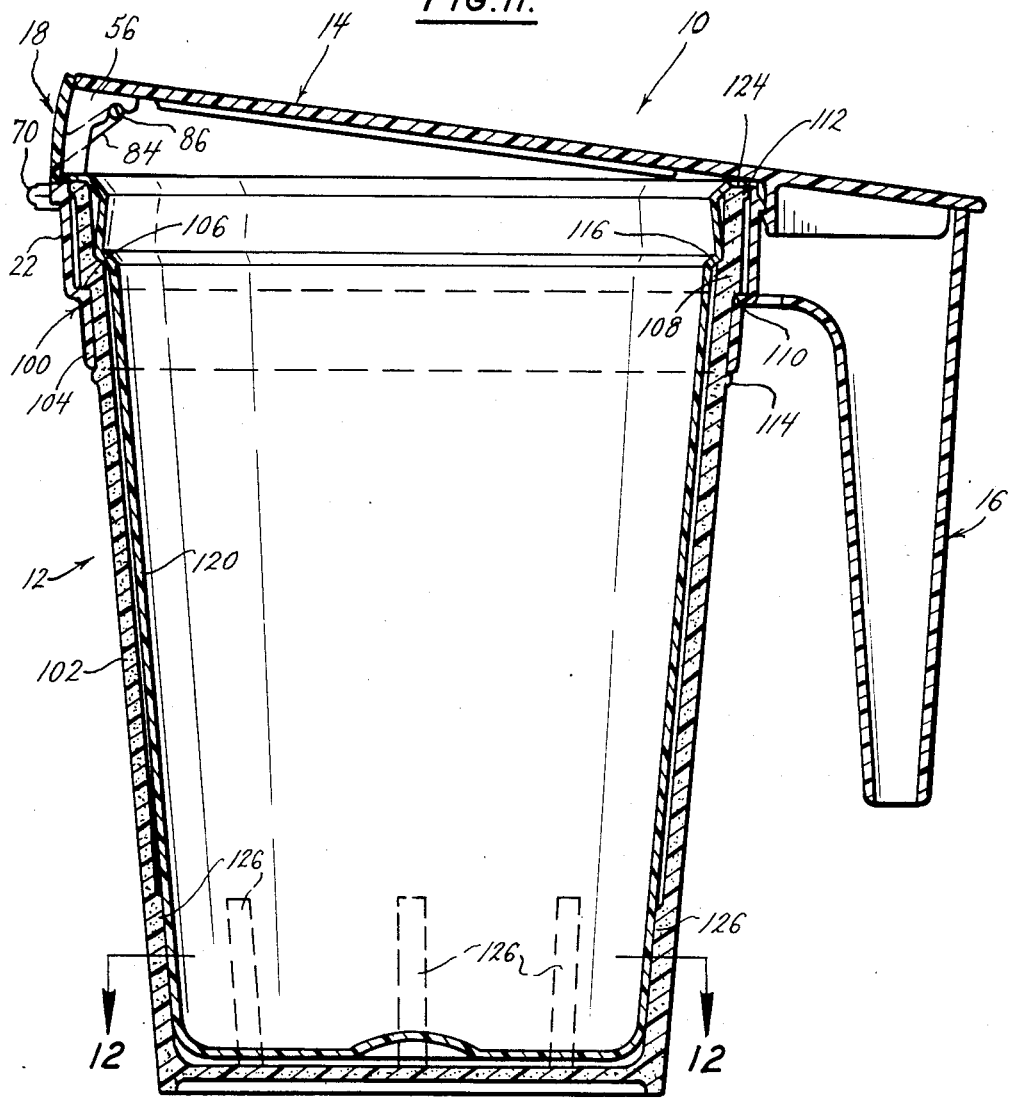
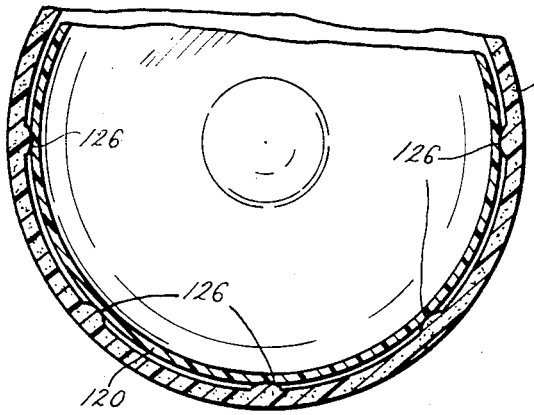
FIG. 12.

WATER PITCHER

This application is a continuation-in-part of patent application Ser. No. 319,110 filed Nov. 9, 1981 now U.S. Pat. No. 4,492,323.

BACKGROUND AND SUMMARY OF THE INVENTION

This invention relates generally to a pitcher, and more specifically to a pitcher for pouring liquids, such as water, into another container for consumption. The invention relates primarily to pitchers of this type that are used in hospitals, nursing homes, and the like.

It is a practice in many hospitals to provide each new patient with certain items that will remain his. A water pitcher is one such item. Because of the large number of patients and the conditions under which the pitchers are used, the pitcher must be relatively inexpensive, yet durable, safe and easy for the patient to use. It must also be designed to maintain sanitary conditions and for ease in handling by the hospital attendants.

Such pitchers are generally known in the art. Examples of these are found in U.S. Pat. Nos. 3,841,528, 3,180,540, D206,345, and D200,018. Typically, such pitchers have a container portion, a lid that overlies the opening at the top of the container, and a spout through which the contents may be poured. In some cases the spout and/or spout opening are formed in the container portion, and in others they are formed in the lid. Typically, the lid may be either a snap on type such as shown in U.S. Pat. No. 3,180,540, or hinged as shown in U.S. Pat. Nos. 3,841,528 and D200,018. Known pitchers may also include a handle such as shown in U.S. Pat. No. 3,841,528, and a cover, or hinged flap, that overlies the spout opening such as in U.S. Pat. No. 3,180,540.

The present invention represents a significant improvement over these known pitchers. The pitcher of the present invention generally comprises a container portion, and a hinged lid at the top thereof allowing pivoting of the lid between an open position for access to the interior of the container and a closed position overlying the top of the container. A spout opening, through which the contents are poured, is located at the hinge, and a handle preferably is located at the side of the pitcher opposite the spout opening. This means that the contents are poured, and the lid opens, in a direction away from the handle. The lid has an extension which is readily engaged by the thumb for prying the lid open while grasping the handle, the handle providing leverage for opening the lid.

The invention provides several important advantages. To appreciate these advantages, it must be remembered that a pitcher for use in a hospital or similar environment must be free of contamination and otherwise safe for the patient. With this invention, the lid is secure during pouring and yet easily opened for refilling and the like without requiring handling of the interior portions of the pitcher which might otherwise become contaminated. Because the lid is hinged at the spout opening, the force of the water and ice, as they are directed toward the spout opening during pouring, is at the location where the lid is hinged so that the hinge itself acts to hold the lid closed where most of the force is directed. Only a small snap is required at the side of the lid opposite that of the hinge to hold the lid securely closed during pouring. This small snap is easily overcome by prying upwardly with the thumb on the lid extension, aided by the leverage provided by the handle. The extension provides a convenient means for opening the lid at a location sufficiently remote from the spout and other areas contacted by the contents of the pitcher to minimize contamination that might otherwise result from touching those areas. Also, with the lid hinged at the location of the spout opening, considerable leverage is applied by use of only the small snap or the like at the side of the lid opposite the spout to ensure a tight seal between the lid and the top of the container portion, particularly at the locations nearest the spout opening, to prevent leakage between the lid and the container.

In one embodiment of the invention, the entire pitcher may be of molded, one-piece, plastic construction, and thus inexpensive with the advantage that the lid, container and handle require no assembly and are permanently attached together for ease in handling. In other embodiments of the invention, the container portion may include a disposable cup portion supported at the top by a ring portion such that the cup portion is easily replaced. In both embodiments, with the lid hinged at the side opposite the handle, the lid and handle tend to balance with the lid open so that the pitcher is stable in an upright position even when empty for ease in filling. This eliminates the need to hold the pitcher upright with one hand while trying to fill it with the other.

Further in accordance with one embodiment of this invention, the lid is hinged to allow the lid to hang generally vertically when fully open.

Also, there may be included a hinged flap, which is also of molded, one-piece, plastic construction, and which swings between a closed position overlying the spout opening with the pitcher in the upright position, and an open position when the pitcher is tilted for pouring. The flap is readily snapped into place during assembly so that no pins or the like are required. The flap includes a cover portion which overlies the spout opening, and a radius arm means extending therefrom forming an acute angle with the cover portion, whereby as the flap swings open, the entire cover portion moves upwardly and away from the spout opening to a limited open position so that in the open position the cover portion of the flap acts to direct the liquid contents out of the container in a controlled manner. Ice guards extend over the spout opening to prevent ice and other large objects from passing through the opening. The guards provide another important function by retaining the flap in the event the flap comes loose from the lid, so that the flap will not fall into the drinking receptacle.

These and other objects and advantages of the invention will be further discussed and will be apparent from the drawing and detailed description to follow.

DESCRIPTION OF THE DRAWINGS

FIG. 1 is an isometric view of a pitcher of the present invention;

FIG. 2 is a front elevation showing the upper portion of FIG. 1;

FIG. 3 is an isometric view similar to FIG. 1, but showing the lid in the opened position;

FIG. 9 is a view taken generally along the line 9—9 of FIG. 7;

FIG. 10 is a view in section taken generally along the line 10—10 of FIG. 5;

FIG. 11 is a side elevation view with portions broken away of another embodiment of the water pitcher of the present invention;

FIG. 12 is a view in section taken along the line 12—12 of FIG. 11;

DETAILED DESCRIPTION OF PREFERRED EMBODIMENTS

Figure 5:
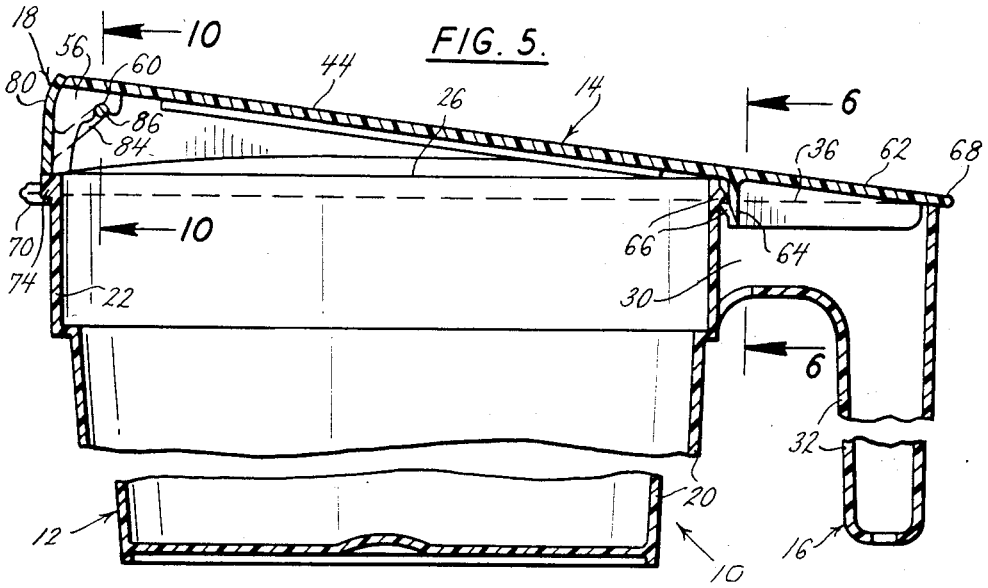
FIG. 5 is an enlarged view in section taken generally along the line 5—5 of FIG. 1.
Figure 6:
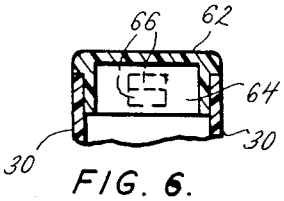
FIG. 6 is a view in section taken generally along the line 6—6 of FIG. 5.

With reference to the drawing, and particularly FIGS. 1 through 10 showing a first embodiment of the invention, there is generally shown a pitcher 10 of the present invention having a container portion 12 for holding the contents which may be typically water and ice. There is also included a hinged lid 14, a handle 16, and a flap or cover 18 for the spout opening.

The container portion 12 is of circular cross section and has a tapered lower portion 20, which is larger at the top than at the bottom, and an enlarged generally cylindrical top portion 22. The portion 22 is somewhat larger than the upper end of the tapered portion 20 so that the pitchers will rest when stacked. The upper edge of the portion 22 defines the opening 26 of the container, and an annular, outwardly extending, rim 28 extends around the container near the upper edge, and acts to seal the lid to the container.

Figure 4:
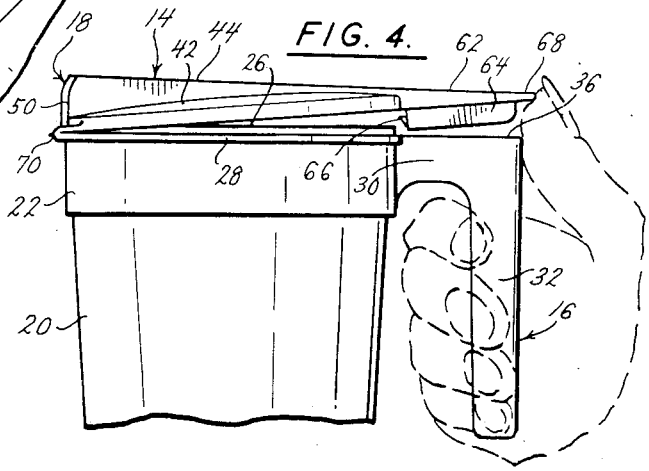
FIG. 4 is a side elevation of the pitcher of FIG. 1, but showing the lid in a partially opened position and illustrating the manner in which the lid may be opened.
Figure 13:
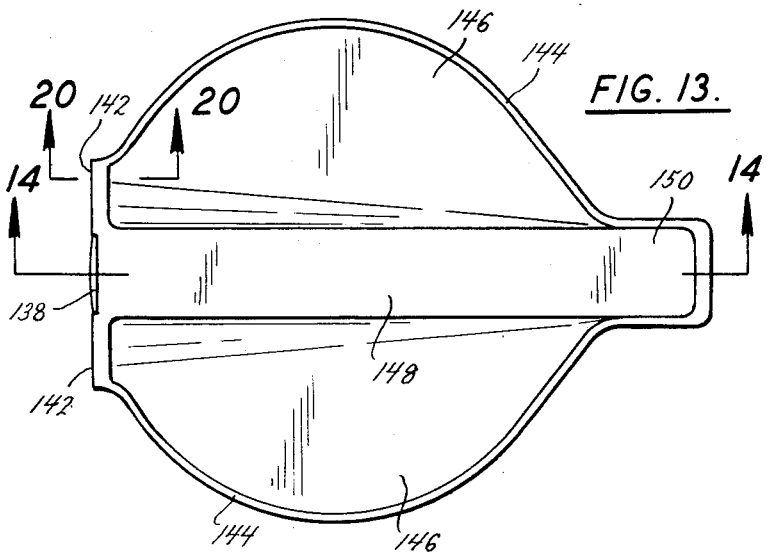
FIG. 13 is a top view of another embodiment of the water pitcher of the present invention.
Figure 14:
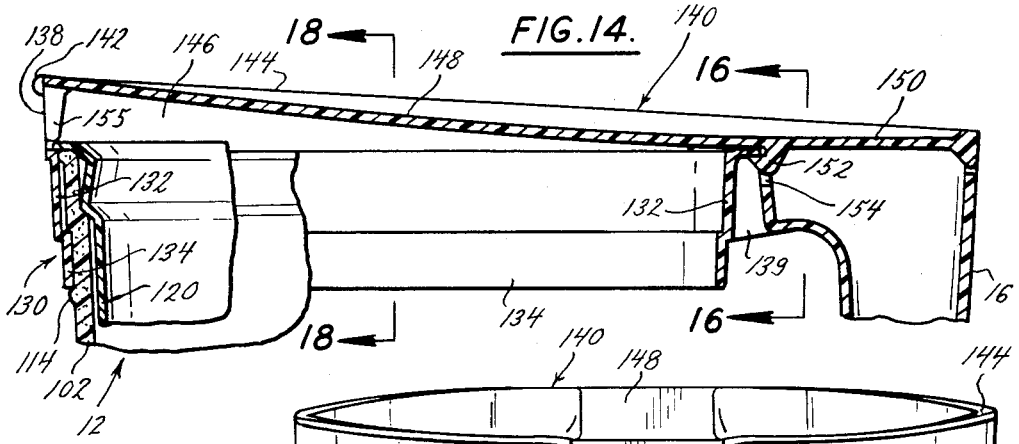
FIG. 14 is a view in section taken generally along the line 14—14 of FIG. 13.
Figure 15:
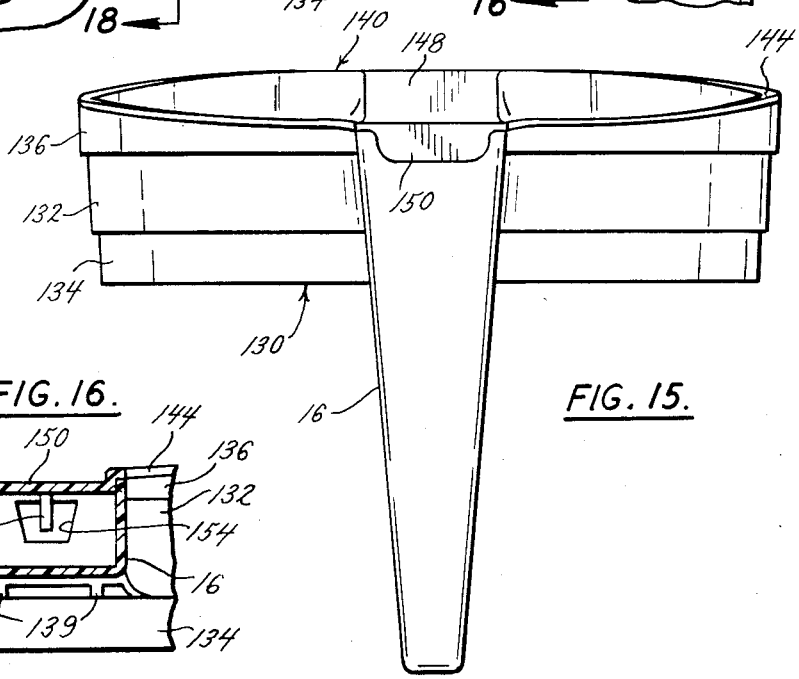
FIG. 15 is a rear view from the handle side of the embodiment of FIG. 13, but without the disposable cup portion.
Figure 16:
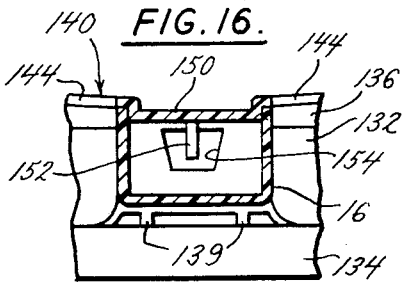
FIG. 16 is a view in section taken generally along the line 16—16 of FIG. 14.

The handle 16 is formed integrally with the container portion and is located at one side (rear side) of the container. In the preferred embodiment, the handle is hollow and has a generally horizontal upper portion 30 secured to the upper portion 22 of the container, and a handle grip 32 extending downwardly therefrom and spaced from the container sufficiently to allow the user to grasp the handle grip with the fingers of one hand as illustrated in FIG. 4. The handle has an upper edge 36 defining a top opening of the handle with the edge 36 generally aligned with the top of the rim 28.

The lid 14 has a generally flat disc portion 42, a downwardly extending annular flange 43 at the periphery, and a raised tapered channel 44 defining a spout and lid extension. The channel 44 extends generally diametrically across the lid and is tapered such that the channel is deeper at the forward end than at the rearward, or handle side, of the lid. The channel has a front edge which itself is tapered and slightly curved at the top, and which defines the spout opening 52 through which the liquid contents may be poured from the pitcher. Thus, the front edge 50 of the spout is not vertical with the pitcher in the upright position, but instead, is tapered back and slightly curved at the top as shown in FIGS. 4 and 5. This ensures closure of the flap 18 under its own weight with the pitcher in the upright position.

Formed integrally with the lid and extending downwardly therefrom at the spout opening, are webs 56 which act as ice guards to prevent ice and other large objects from passing through the spout opening. The webs are sufficiently long so that they extend to the top edge 26 of the container when the lid is closed as shown in FIGS. 5, 7, 9 and 10. Each web has a portion extending rearwardly from the spout opening and has a recess 60 (FIGS. 3, 5 and 7) located near the top of the channel 44 for hingedly mounting the flap 18 as will be further described.

In alignment with the channel 44 and extending rearwardly therefrom is a thumb engaging lid extension 62 which overlies the handle opening with the lid closed. The thumb engaging extension is formed integrally as part of the lid and has a member 64 extending downwardly therefrom and into the top of the handle with the lid closed. The member 64 and top of the container have raised tapered members 66 which engage or snap together to releasably hold the lid closed. The lid extension 62 has a rearward overhang or lip 68 which extends slightly beyond the rear side of the handle, for engagement by the thumb while grasping the handle grip with the fingers of one hand, for prying the lid open as illustrated in FIG. 4. In prying the lid open, the handle provides leverage for releasing the snap means which are located near where the thumb pressure is applied for ease in opening the lid.

The lid is hinged at the top of the container at the location of the spout opening so that both the hinge and the spout are at the side of the container opposite the handle. More specifically, the hinge is formed integrally with the container portion and lid and includes web portions 70 on opposite sides of the spout opening with each web portion extending between the rim 28 and the flange 43. A double seal is formed between the lid and container. The dimensions of the flange 43 are such that with the lid closed, the flange surrounds the upper edge of the container portion with the bottom edge of the flange engaging the rim 28, thus forming a liquid seal between the flange and the rim. Another seal is formed between the sides of the top edge of the container 26 and the inside of the flange of the lid. This double sealing is enhanced by the fact that the lid is in effect a lever operated by the small snap 66 or by downward pressure of the thumb during pouring to effect a seal between the flange and rim particularly over the forward portion of the lid most often contacted by the liquid during pouring. A short lip 74 is located between the hinge members 70 at the location of the rim 28.

Figure 7:
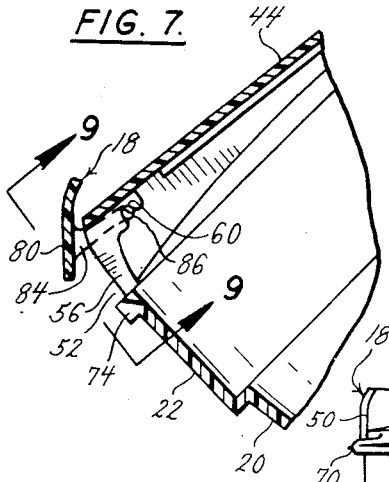
FIG. 7 is a sectional view similar to FIG. 5, but showing that portion of the pitcher near the spout opening and showing the flap of the present invention in the opened position.
Figure 8:
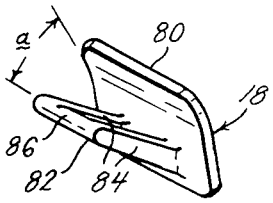
FIG. 8 is an isometric view of the flap of the present invention.

The flap 18 includes a cover 80 of the same profile as the spout opening which overlies the spout opening with the pitcher in the upright position as shown in FIGS. 1, 2, 4 and 5. A radius arm 82 extends rearwardly from the cover at an acute angle a (FIG. 8) and from a location of the cover nearer its bottom edge than its top. More specifically, the radius arm 82 comprises spaced arms 84 and a cross bar 86 which seats in snapping engagement in the recesses 60 of the webs 56. As shown in FIG. 7 (see also FIG. 9), when the pitcher is tilted to the pouring position, the flap swings by its own weight, aided by the liquid impinging on the inner surface of the cover portion, to an open position. With the flap in the fully open position as shown in FIG. 7, the arms 84 engage the top of the channel of the lid to restrict further swinging movement of the flap. With the flap so restricted, the liquid continues to impinge upon the inner surface of the cover portion with the cover portion acting to direct the liquid downwardly toward the container into which it is poured. It will further be noted, that as the flap swings from its closed to its open position, the entire cover portion swings upwardly and away from the spout opening.

It should be noted that the only assembly required is to attach the flap to the lid which is accomplished by simply opening the lid and snapping the cross bar 86 into the recesses 60. In the unlikely event that the cross bar comes out of the recess during pouring, the flap is retained by the webs to prevent the flap from falling with the water into the drinking cup.

Another embodiment of the invention is shown in FIGS. 11 and 12 of the drawing. Much of the description of the previously described embodiment also applies to the embodiment of FIGS. 11 and 12, and therefore need not be repeated. This embodiment differs from the one previously described, in that rather than the container portion 12 being of one piece construction, with this embodiment the container portion comprises a ring portion 100 which supports a disposable or replaceable cup portion 102 at the top thereof. The ring portion 100 includes the enlarged generally cylindrical top portion 22 of the first embodiment to which the lid 14 and handle 16 are mounted as with the first embodiment. Depending beneath the cylindrical portion 22 is a tapered ring 104 of slightly less diameter than the cylindrical portion, forming an annular shoulder therebetween as with the first embodiment, and which is designated 106 in FIG. 11.

The cup portion 102 is a suitable material such as expanded polystyrene foam or the like, and has the same taper as the ring 104. The top of the cup portion also has a slightly enlarged cylindrical portion 108 of slightly less diameter than that of the cylindrical portion 22. At the bottom of the cylindrical portion 108 is an annular shoulder 110 which rests on the shoulder 106 when the cup is inserted into the ring. At the top of the cup portion is a small external annular bead 112. Another external annular bead 114 is spaced downwardly from the top of the cup just under the bottom edge of the ring 100. Also spaced somewhat downwardly from the top of the cup is an internal annular shoulder 116.

The cup is dimensioned such that when fully inserted into the ring 100, the top of the cup is flush with the top of the ring, the bead 112 resting snugly against the internal surface at the top of the ring, with the shoulder 100 of the cup resting on the shoulder 106 of the ring. The cup also rests snugly against the internal surface of the portion 104, and the bead 114 is just beneath the portion 104. In this way, the cup is easily and securely placed within the ring by placing it downwardly through the top of the ring until the bead 114 clears the portion 104 and snaps into place just beneath it, with the mating shoulders 106 and 110 in engagement and with the bead 112 snugly against the top of the ring. One way to accomplish this is to place the cup loosely within the ring. Closing the lid will then press the cup into place as described. The bead 114 prevents the ring from becoming inadvertently dislodged from the cup while the lid is open, but allows the cup to be easily removed with moderate force.

An optional replaceable liner 120, of any suitable material such as vacuum formed polystyrene, is shaped to nest within the cup. As shown in FIG. 11, the liner has a flange 124 at the top which rests on the top edge of the cup and the top edge of the ring. As shown in FIG. 12, the cup may have internal vertical ribs 126 to snugly engage the liner near its lower end to hold it in place within the cup under normal use.

Another embodiment of the invention is shown in FIGS. 13 through 21 of the drawing. Much of the description of the previously described embodiments also applies to the embodiment of FIGS. 13 through 21, and therefore need not be repeated. This embodiment differs from those previously described principally in that the lid is hinged to allow the lid to hang generally vertically when fully open. Thus, the container portion 12 of the embodiment of FIGS. 13 through 21 includes a ring portion 130 which supports the disposable or replaceable cup portion 102. The ring portion 130 includes tapered portions 132 and 134. The disposable cup portion 102 fits within the portions 132 and 134 as with the previously described embodiment.

Unlike the embodiment of FIGS. 11 and 12, the ring 130 also includes a slightly enlarged top section 136 which slopes downwardly from a spout opening 138, formed in the front side thereof, toward the handle 16. Reinforcing webs 139 are located between the handle and the portion 132 of the ring 130.

A lid 140 is hinged at the top of the spout opening by webs 142 connected between the lid and the section 136 at either side of the spout opening. The lid has an annular rim 144 with recessed central portions 146 which conform generally to the sloping shape of the section 136, and which define therebetween a raised channel 148. The channel 148 is similar to and performs the same function as the channel 44 of the previously described embodiment. The lid 140 includes a thumb engaging lid extension 150, and a snap member 152, similar to and performing the same functions as the extension 62 and snap member 66 of the previously described embodiment. The member 152 snaps within an opening 154 in an inside wall of the handle to hold the lid closed. The bottoms of the recessed portions 146 are spaced slightly above the top edge of the portion 132 to allow room for the rim of the optional liner 120. Webs 155 depend from the rim 144 at the location of the spout opening and are of sufficient length to extend substantially the entire height of the spout opening. Like the webs 56 of the previously described embodiments, the webs 155 act as ice guards.

The embodiment of FIGS. 13 through 21 operates in much the same manner as that of FIGS. 11 and 12, except that with the lid hinged at its top edge and above the spout opening, the lid may be opened to where it is generally vertical. In other words, the lid is allowed to pivot through an angle greater than 180° between an open generally vertical position and a closed position. This makes it possible to in effect fold the lid further back toward the container portion when opened for better balance and less protrusion.

Figure 19:
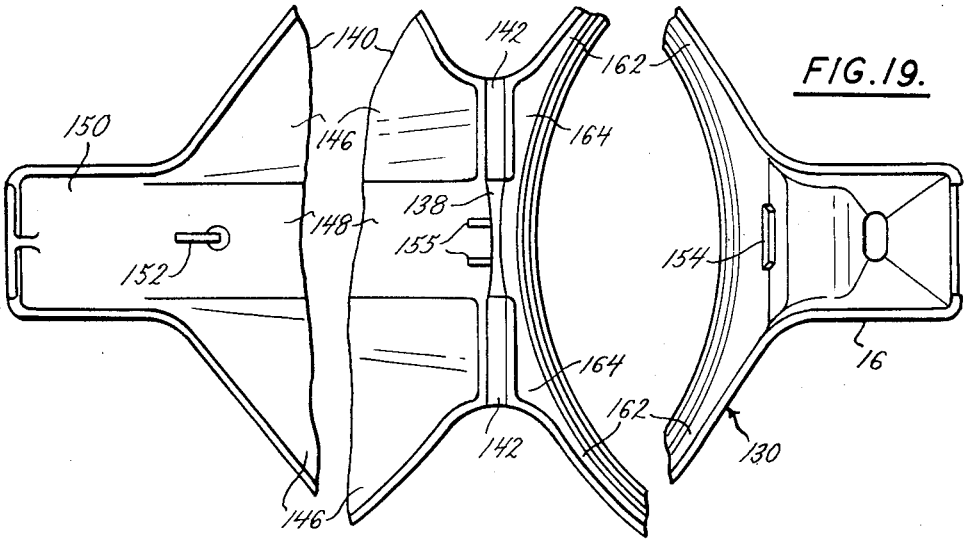
FIG. 19 is a broken top view of the embodiment of FIG. 13 with the lid open to a generally horizontal position.
Figure 17:
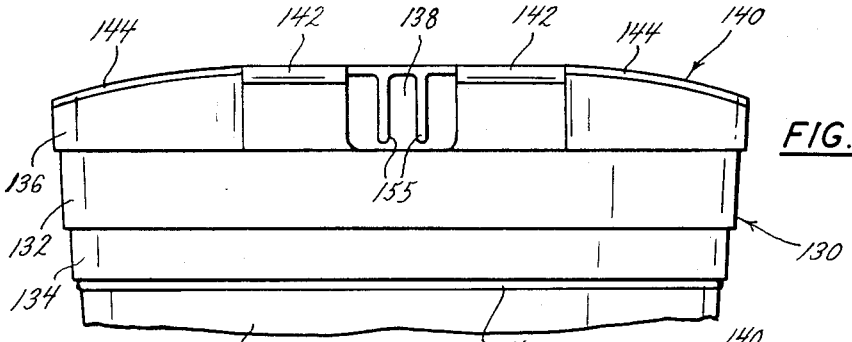
FIG. 17 is a front view from the spout side of the embodiment of FIG. 13.
Figure 18:
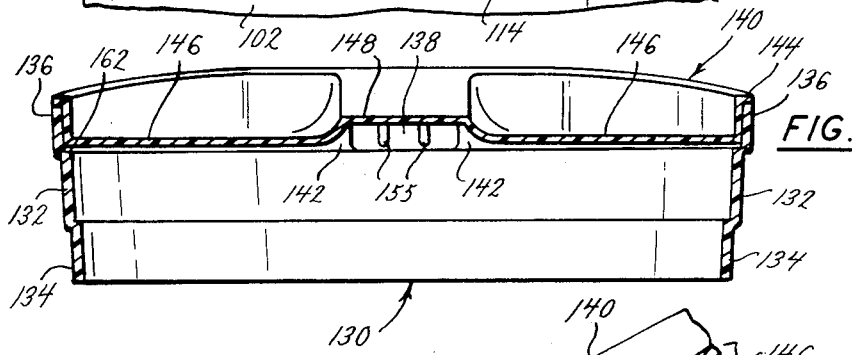
FIG. 18 is a view in section taken generally along the line 18—18 of FIG. 14, but without the disposable cup portion.
Figure 20:
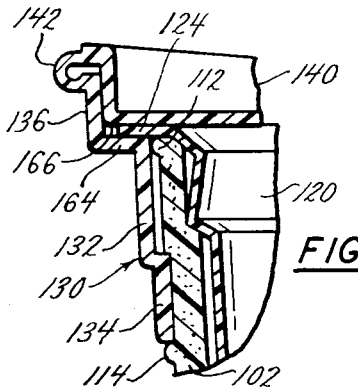
FIG. 20 is a view in section taken generally along the line 20—20 of FIG. 13 and showing the lid closed.
Figure 21:
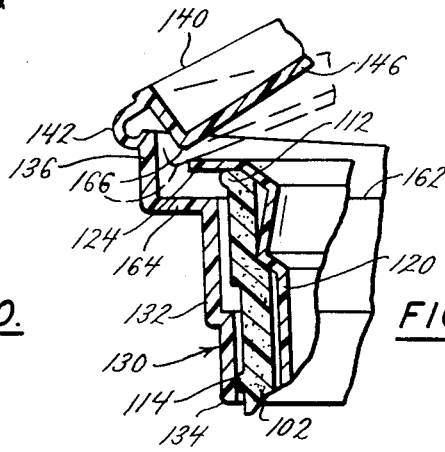
FIG. 21 is a view similar to that of FIG. 20, but with the lid partially closed.

It will be noted that with the lid closed, the recesses 146 seat within the ring portion 136. As shown in FIGS. 19, 20 and 21, the annular shoulder 162 between the ring portions 136 and 132 is wider at the locations 164 beneath the hinges. To insert the disposable cup portion in the ring, the cup may be placed loosely within the ring so that its upper end extends slightly above the shoulder 162 as shown in FIG. 21. The cup is then depressed to the fully seated position shown in FIG. 20 by closing the lid. As the lid is closed, because the shoulder 162 is wider at the locations 164, the lower front edges 166 of the recesses will clear the top of the cup so that the bottoms of the recesses will press downwardly on the top of the cup to depress the cup into the fully seated position as shown in FIG. 20. The liner may be first inserted into the cup and then both inserted into the ring as described above, or the liner may be inserted after the cup is fully seated. Of course, the cup and liner may also be fully inserted by holding the ring with one hand and pushing against the tops of the cup and liner with the other.

While the embodiment of FIGS. 13 through 21 is shown with a disposable cup portion, it is to be understood that its lid configuration and hinged attachment of the lid may also be used with the embodiment of FIGS. 1 through 10, where the container portion 12 is of one piece construction.

There are various changes and modifications which may be made to applicant's invention as would be apparent to those skilled in the art. However, any of these changes or modifications are included in the teaching of applicant's disclosure and he intends that his invention be limited only by the scope of the claims appended hereto.

What is claimed is:

1. A pitcher for pouring liquid comprising a container portion having a top opening, said container portion having a ring portion and a replaceable cup portion supported at the top thereof by the ring portion, a lid hinged to the ring portion near the periphery thereof allowing pivoting of the lid between an open position for access to the interior of the container and a closed position over the container opening, said top opening and lid being sized to expose substantially the entire interior of said container portion with the lid open, said pitcher having a spout opening near the periphery of said ring portion on the same side as said hinge for the pouring of the contents therethrough.

2. The pitcher of claim 1 further comprising interengaging means between said ring and cup portions for holding said portions against relative vertical movement under normal use with the cup portion seated within the ring.

3. The pitcher of claim 1 further comprising a replaceable internal liner nested within said cup portion.

4. The pitcher of claim 1 wherein the top of the cup portion is generally flush with the top of the ring, and means providing a generally snug fit between the ring and cup portions.

5. The pitcher of claim 1 further comprising a handle at the side of the ring portion opposite the spout and hinge.

6. The pitcher of claim 5 wherein said lid has an extension opposite its hinged side for engagement by the thumb.

7. The pitcher of claim 1 wherein with the cup portion fully inserted within the ring portion, the top of the cup portion is generally flush with the top of the ring portion with a snug fit therebetween, and further comprising interengaging means between said ring and cup portions for holding said portions against relative vertical movement under normal use with the cup portion seated within the ring.

8. The pitcher of claim 1 wherein said lid is hinged at the top of the ring portion.

9. The pitcher of claim 1 wherein said ring portion has a handle.

10. A pitcher for pouring liquid comprising a container portion having a top opening, a lid hinged at the top of the container portion near the periphery thereof allowing pivoting of the lid through an angle greater than 180° between an open generally vertical position for access to the interior of the container and a closed position over the container opening, said top opening and lid being sized to expose substantially the entire interior of said container portion with the lid open, said pitcher having a spout opening near the periphery of said container portion on the same side as said hinge for the pouring of the contents therethrough.

11. The pitcher of claim 10 wherein said pitcher has a handle.

12. The pitcher of claim 10 further comprising a handle located at the side of the pitcher opposite the spout and hinge.

13. The pitcher of claim 12 wherein said lid has an extension opposite its hinged side for engagement by the thumb.

14. The pitcher of claim 13 wherein said extension has a lip projecting beyond the handle and positioned for engagement by the thumb to pry the lid from its closed position while grasping the handle with the fingers of the hand, said handle providing leverage for prying the lid.

15. The pitcher of claim 13 wherein said lid extension overlies the top of the handle, and further comprising releasable means for releasably holding the lid in closed engagement over said container opening.

16. The pitcher of claim 10 wherein said spout opening is formed in said container portion, and said lid is hinged above said spout opening.

17. The pitcher of claim 16 wherein said lid has a channel defining a spout leading to the spout opening with the lid in the closed position.

18. A pitcher for pouring liquid comprising a container portion having a top opening, said container portion having a ring portion and a replaceable cup portion supported thereby, a lid hinged to the ring portion allowing pivoting of the lid through an angle greater than 180° between an open generally vertical position for access to the interior of the container and a closed position over the container opening, said pitcher having a spout opening on the same side as said hinge for the pouring of the contents therethrough.

19. The pitcher of claim 18 further comprising interengaging means between said ring and cup portions for holding said portions against relative vertical movement under normal use with the cup portion seated within the ring.

20. The pitcher of claim 18 further comprising a replaceable internal liner nested within said cup portion.

21. The pitcher of claim 18 further comprising a handle located at the side of the ring portion opposite the spout and hinge.

22. The pitcher of claim 21 wherein said lid has an extension opposite its hinged side for engagement by the thumb.

23. The pitcher of claim 18 wherein said ring portion has a handle.

24. A pitcher for pouring liquid comprising a container portion having a top opening, said container portion having a ring portion and a replaceable cup portion supported at the top thereof by the ring portion, a lid hinged to the ring portion allowing pivoting movement of the lid between an open position for access to the interior of the container and a closed position over the container portion, said pitcher having a spout opening on the same side as said hinge for the pouring of the contents therethrough, said ring portion having a handle, the handle having a downwardly extending portion adapted for grasping by the fingers of the hand for pouring said liquid.

25. A pitcher for pouring liquid comprising a container portion having a top opening, said container portion having a ring portion and a replaceable cup portion supported thereby, a lid hinged to the ring portion allowing pivoting of the lid through an angle greater than 180° between an open generally vertical position for access to the interior of the container and a closed position over the container opening, said pitcher having a spout opening formed in said ring portion on the same side as said hinge for the pouring of the contents therethrough, said lid being hinged above said spout opening.

* * * * *